US008931193B1

(12) United States Patent
Bogart et al.

(10) Patent No.: US 8,931,193 B1
(45) Date of Patent: Jan. 13, 2015

(54) FIREARM SUPPORT APPARATUS AND METHOD

(71) Applicants: Mark Bogart, Joshua, TX (US); Daniel Bogart, Joshua, TX (US)

(72) Inventors: Mark Bogart, Joshua, TX (US); Daniel Bogart, Joshua, TX (US)

( * ) Notice: Subject to any disclaimer, the term of this patent is extended or adjusted under 35 U.S.C. 154(b) by 147 days.

(21) Appl. No.: 13/669,872

(22) Filed: Nov. 6, 2012

Related U.S. Application Data

(63) Continuation-in-part of application No. 12/702,679, filed on Feb. 9, 2010, now Pat. No. 8,307,576.

(51) Int. Cl.
*F41A 21/00* (2006.01)

(52) U.S. Cl.
USPC ..... 42/1.06; 248/163.1; 89/40.06; 42/94

(58) Field of Classification Search
CPC ..... F41A 23/16; F41A 23/02; F41A 23/18; F41A 23/06; F41A 23/10; F41A 23/14; F41A 23/12
USPC ..... 248/163.1; 89/40.06; 42/94
See application file for complete search history.

(56) References Cited

U.S. PATENT DOCUMENTS

| | | | | |
|---|---|---|---|---|
| 3,876,078 | A * | 4/1975 | Gomes et al. | 211/64 |
| 4,026,057 | A | 5/1977 | Cady | |
| 5,070,636 | A * | 12/1991 | Mueller | 42/94 |
| 5,628,135 | A * | 5/1997 | Cady | 42/94 |
| 6,526,687 | B1 * | 3/2003 | Looney | 42/94 |
| 6,546,662 | B1 | 4/2003 | Chong | |
| 6,877,266 | B1 * | 4/2005 | Brownlee | 42/94 |
| D521,100 | S | 5/2006 | Morrow | |
| D553,219 | S | 10/2007 | Potterfield | |
| D576,245 | S | 9/2008 | Potterfield et al. | |
| 7,584,690 | B2 | 9/2009 | Cauley | |
| 7,587,854 | B2 * | 9/2009 | Werner | 42/94 |
| 8,052,104 | B2 | 11/2011 | Clampitt | |
| 8,307,576 | B1 * | 11/2012 | Bogart et al. | 42/94 |
| 8,316,571 | B1 * | 11/2012 | Holland | 42/94 |
| 2005/0000141 | A1 * | 1/2005 | Cauley et al. | 42/94 |
| 2008/0134555 | A1 * | 6/2008 | Werner | 42/69.01 |
| 2011/0094140 | A1 * | 4/2011 | Letson | 42/94 |
| 2012/0186125 | A1 * | 7/2012 | Werner | 42/94 |

* cited by examiner

*Primary Examiner* — Samir Abdosh
(74) *Attorney, Agent, or Firm* — Eric Karich

(57) ABSTRACT

A firearm support apparatus has a support frame having an elongate longitudinal center body and a lateral crosspiece having right and left sides that extend outwardly from the center body. The apparatus also includes a forward cradle assembly, a rearward cradle assembly, an outwardly extending flanges, and a pair of adjustable legs for adjusting the height of the lateral crosspiece with respect to the ground.

2 Claims, 6 Drawing Sheets

FIREARM SUPPORT APPARATUS AND METHOD

CROSS-REFERENCE TO RELATED APPLICATIONS

This application for a utility patent is a continuation-in-part of a previously filed utility patent, still pending, having the application Ser. No. 12/702,679, filed Feb. 9, 2010.

STATEMENT REGARDING FEDERALLY SPONSORED RESEARCH

Not Applicable

BACKGROUND OF THE INVENTION

1. Field of the Invention

This invention relates generally to firearm supports, and more particularly to a forearm support apparatus for supporting a rifle and for adjusting the aim of the rifle while the rifle is mounted on the apparatus.

2. Description of Related Art

Gun rests are useful tools for accurately sighting rifles and similar firearms. It is important that the shooter, such as a hunter, be able to maintain a shooting position with the gun properly aimed for periods of time (e.g., while waiting for a target such as a deer to arrive). Accurate sighting and adjustment of the gun sights is especially critical for shooting at long ranges, where small changes in relative position of the gun can result in significant shooting errors.

Various prior art references teach gun rests of various construction and design. For example, Brownlee, U.S. Pat. No. 6,877,266, teaches a forearm support that includes a front support assembly and a rail assembly operatively coupled to the front support assembly. The support includes a horizontal adjustment mechanism for adjusting the position of the firearm.

Looney, U.S. Pat. No. 6,526,687, teaches a gun rest that includes a table having a forward fore stock support, and a rearward butt stock support. The fore stock support is mounted on a front of the table, and includes a screw that pushes against the bias of an internal spring for horizontal adjustment of the support. Both the forward and rearward supports include screws for the vertical adjustment of the gun. Another example of a similar construction is shown in Cady, U.S. Pat. No. 4,026,057. The above-described references are hereby incorporated by reference in full.

The prior art teaches firearm supports that are horizontally and vertically adjustable. However, the prior art does not teach a horizontal and vertical adjustment mechanisms that includes the benefits of construction and ease of use as taught in the present invention. The present invention fulfills these needs and provides further related advantages as described in the following summary.

SUMMARY OF THE INVENTION

The present invention teaches certain benefits in construction and use which give rise to the objectives described below.

The present invention provides a firearm support apparatus for supporting a rifle. The firearm support apparatus has a support frame having an elongate longitudinal center body and a lateral crosspiece having right and left sides that extend outwardly from the center body; a forward cradle assembly mounted on a center section of the lateral crosspiece, the forward cradle assembly comprising cradle arms fitting around and supporting the forward part of the rifle; and a rearward cradle assembly mounted on a rearward portion of the longitudinal center body for supporting the rearward part of the rifle In one embodiment, the firearm support apparatus further comprises an outwardly extending flange that extends from each of the right and left sides of the lateral crosspiece, away from the forward cradle assembly, each of the outwardly extending flanges having a threaded aperture therethrough. In this embodiment, the firearm support apparatus further comprises a pair of adjustable legs for adjusting the height of the lateral crosspiece with respect to the ground, each of the legs having an externally threaded surface, an adjustment knob mounted at a top end of the leg, and a lower end that includes a support base, each of the adjustable legs being positioned through and threadedly engaging the threaded aperture of one of the outwardly extending flanges, so that the adjustment knob is operably positioned for use by the user while firing the rifle, the adjustment knob enabling the user to easily rotate the leg, which then moves relative to the flange to adjust the vertical position of the lateral crosspiece, thereby adjusting the vertical height of the forward part of the rifle. In another embodiment, the invention teaches a method for aiming a rifle using the above-described firearm support apparatus.

In another embodiment, the firearm support apparatus further comprises a recoil support plate mounted on the rearward cradle assembly and positioned adjacent to and between the rear cradle arms for receiving recoil forces from the rifle when it is fired.

In another embodiment, the firearm support apparatus further comprises a pair of posts extending from the lateral crosspiece opposite the elongate longitudinal center body, and on opposite sides of the forward cradle assembly; and a crossbar connecting the pair of posts, the crossbar being oriented generally parallel to the lateral crosspiece.

A primary objective of the present invention is to provide a firearm support apparatus having advantages not taught by the prior art.

Another objective is to provide a firearm support apparatus that includes a vertical adjustment mechanism that includes the benefits of construction and ease of use as taught in the present invention.

Another objective is to provide a firearm support apparatus that includes a horizontal adjustment mechanism that includes the benefits of construction and ease of use as taught in the present invention.

Another objective is to provide a firearm support apparatus that includes a recoil support plate that facilitates firing the rifle.

Another objective is to provide a firearm support apparatus that includes a pair of posts that support a crossbar that is generally parallel to the lateral crosspiece.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a firearm support apparatus for supporting a rifle.

Figure 1:
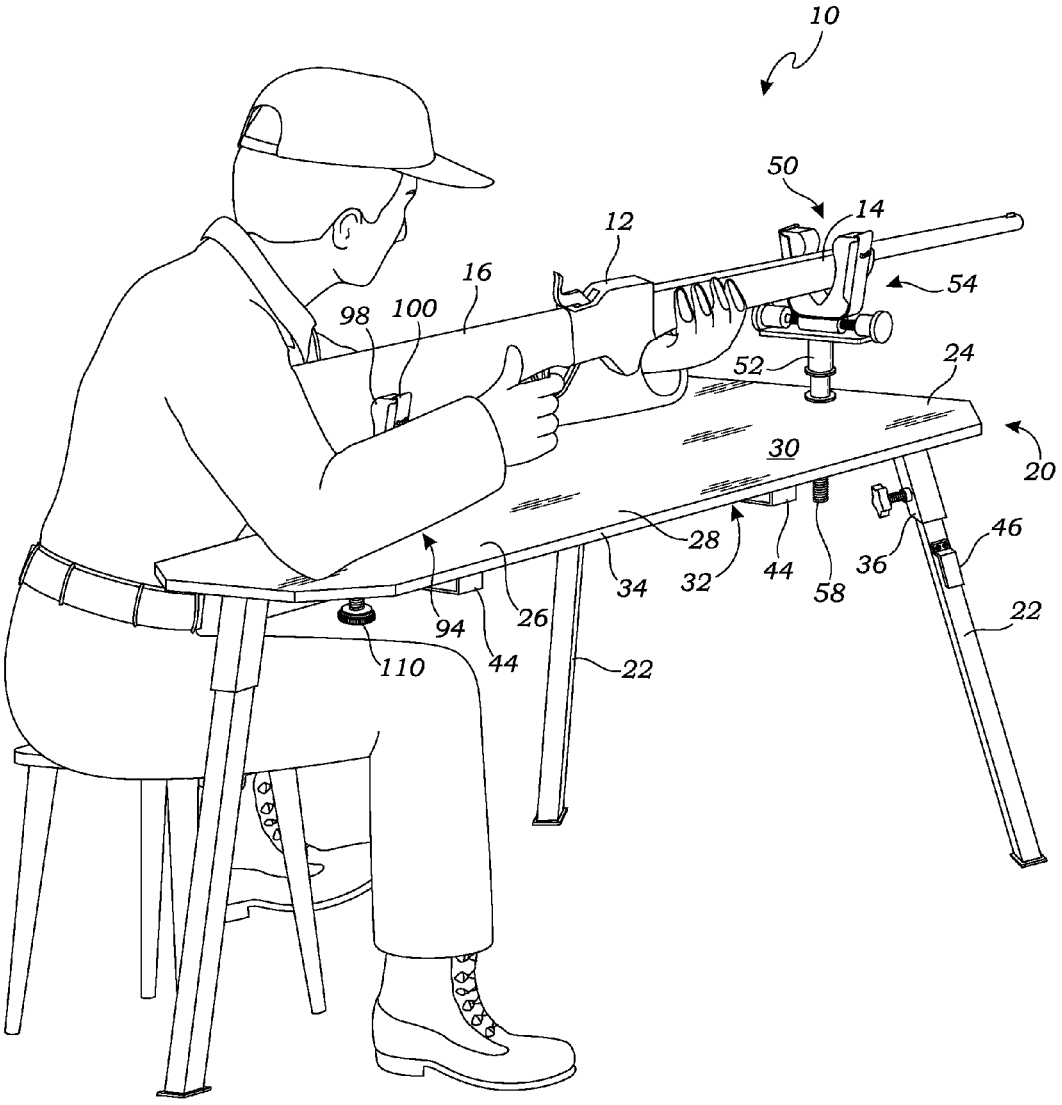
FIG. 1 is a perspective view of a firearm support apparatus according to one embodiment of the present invention, illustrating a hunter using a rifle operably mounted on the firearm support apparatus.
Figure 2:
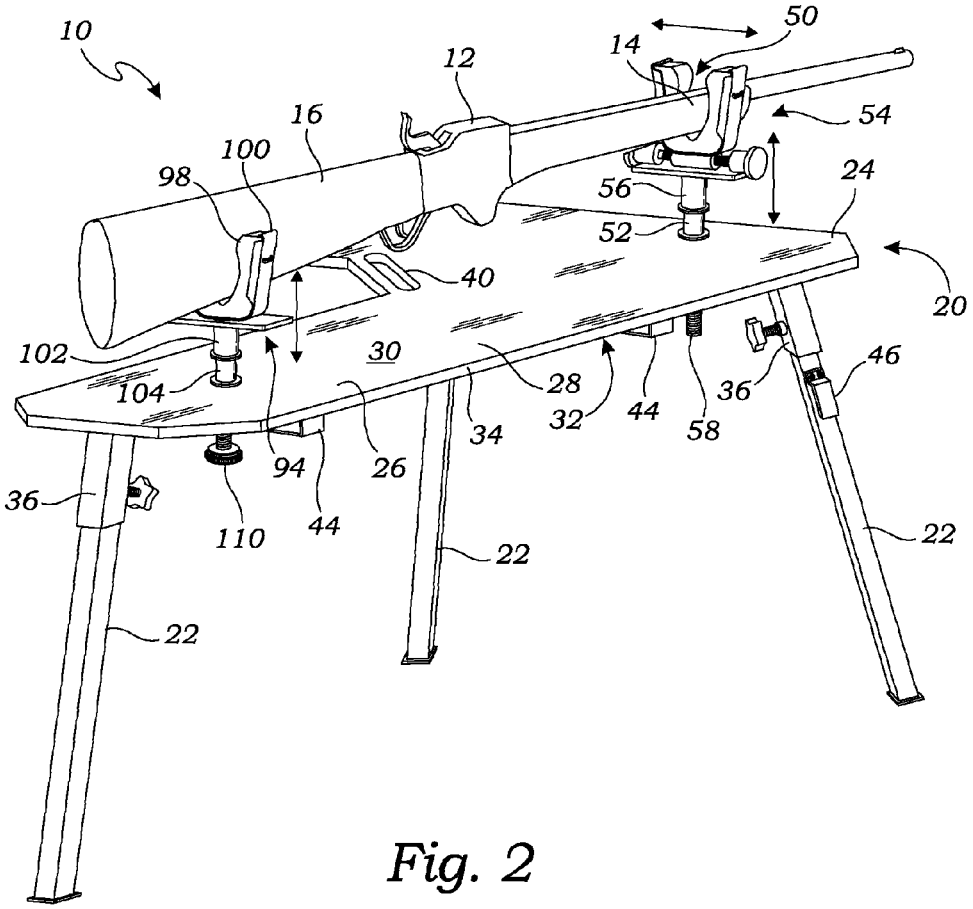
FIG. 2 is a perspective view of the firearm support apparatus, illustrating a table element having a forward cradle assembly and a rearward cradle assembly, the table element being supported in a horizontal configuration on legs.
Figure 3:
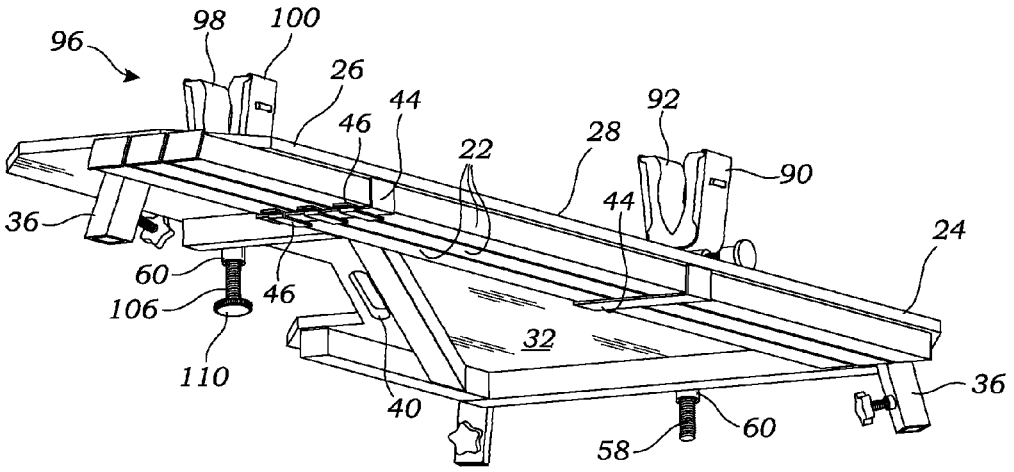
FIG. 3 a bottom perspective view of the firearm support apparatus, illustrating the legs in a stored configuration.
Figure 4:
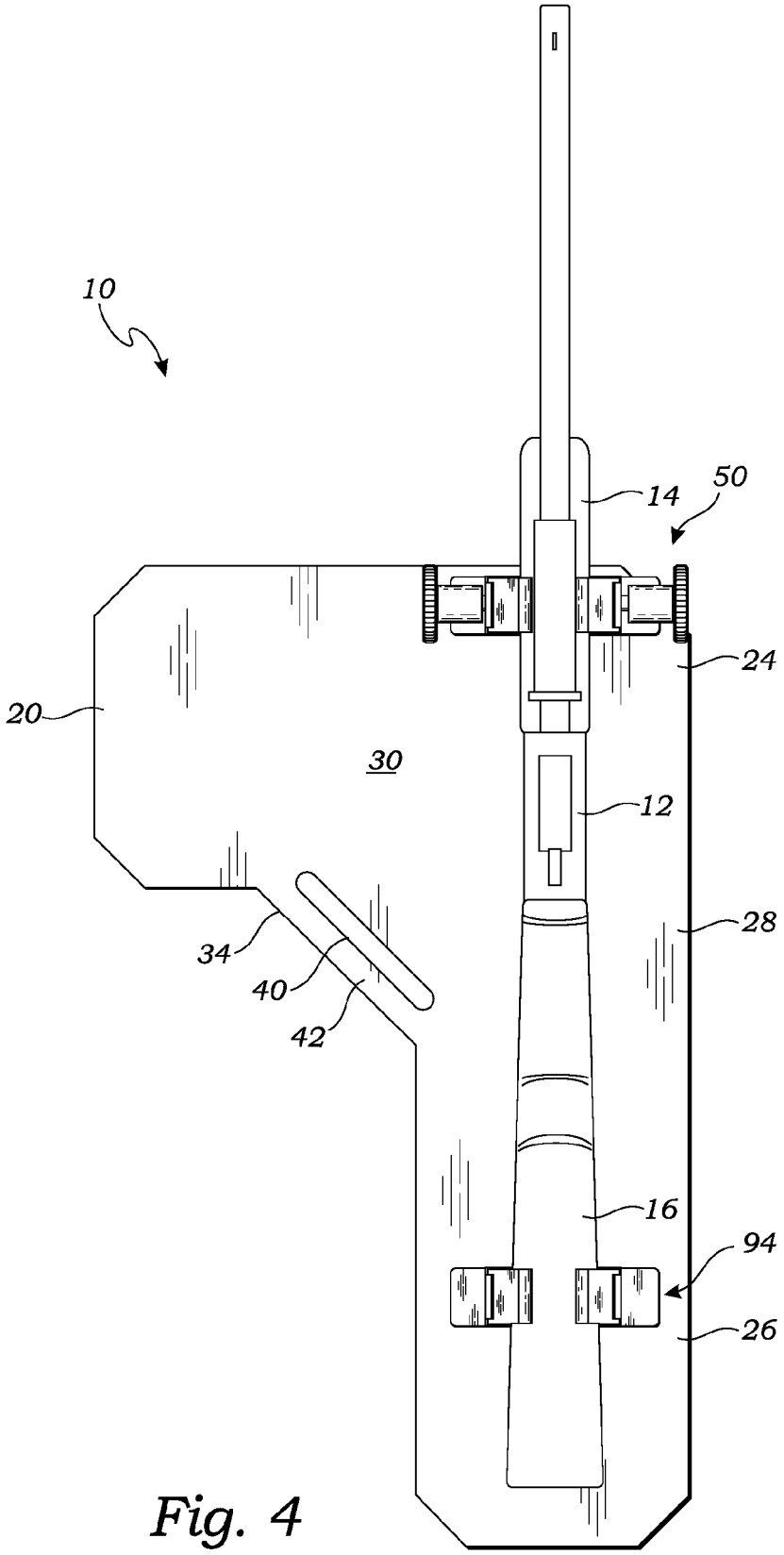
FIG. 4 is a top plan view of the firearm support apparatus of FIG. 2.

FIG. 1 is a perspective view of a firearm support apparatus 10 according to one embodiment of the present invention, illustrating a hunter using a rifle 12 operably mounted on the firearm support apparatus 10. FIG. 2 is a perspective view of the firearm support apparatus 10, illustrating a table element 20 supported in a horizontal configuration on legs 22. FIG. 3 a bottom perspective view of the firearm support apparatus 10, illustrating the legs 22 once they have been removed and placed in a stored configuration, described below. FIG. 4 is a top plan view of the firearm support apparatus 10 of FIG. 2.

As illustrated in FIGS. 1-4, the table element 20 operably supports a forward cradle assembly 50 and a rearward cradle assembly 94. The table element 20 has legs 22 for supporting the table element 20 in a generally horizontal configuration. The table element 20 has a forward portion 24 and a rearward portion 26. The table element 20 is generally shaped and configured for use by a hunter (e.g., hunting from a blind, or otherwise), so that the hunter may sit at or adjacent the table element 20, such that the hunter is comfortably able to aim the rifle 12.

In one embodiment, the forward portion 24 and the rearward portion 26 are connected by a center body 28. The center body 28 may be a planar structure, similar to a standard table. The table element 20 may include a top surface 30 and an opposed bottom surface 32 connected by an edge 34. In one embodiment, the table element 20 includes leg receivers 36 for receiving the legs 22, which may be separable from the table element 20. The leg receivers 36 are positioned such that when the legs 22 are installed in the leg receivers 36, the legs 22 function to support the table element 20 in a generally horizontal configuration, as described above.

A slot 40 may be formed through the table element 20 adjacent the edge 34 forming a handle element 42, between the slot 40 and the edge 34, for carrying the table element 20. The slot 40 is preferably the size of a human hand to facilitate carrying the table element 20.

In one embodiment, the table element 20 includes a storage rack 44 (in this embodiment, a pair of storage racks) mounted adjacent the bottom surface 32 of the table element 20 for receiving and storing the legs 22 between the storage rack 44 and the table element 20. In one embodiment, a locking arm 46 extends from each of the legs 22. The locking arm 46 is shaped to interlock with one of the storage racks 44 for locking the leg between the storage racks 44 and the table element 20. In one embodiment, the locking arm 46 is generally L-shaped, but alternative shapes and structures may be utilized to store the legs 22 beneath the table element 20, and such alternatives should be considered within the scope of the present invention.

Figure 5:
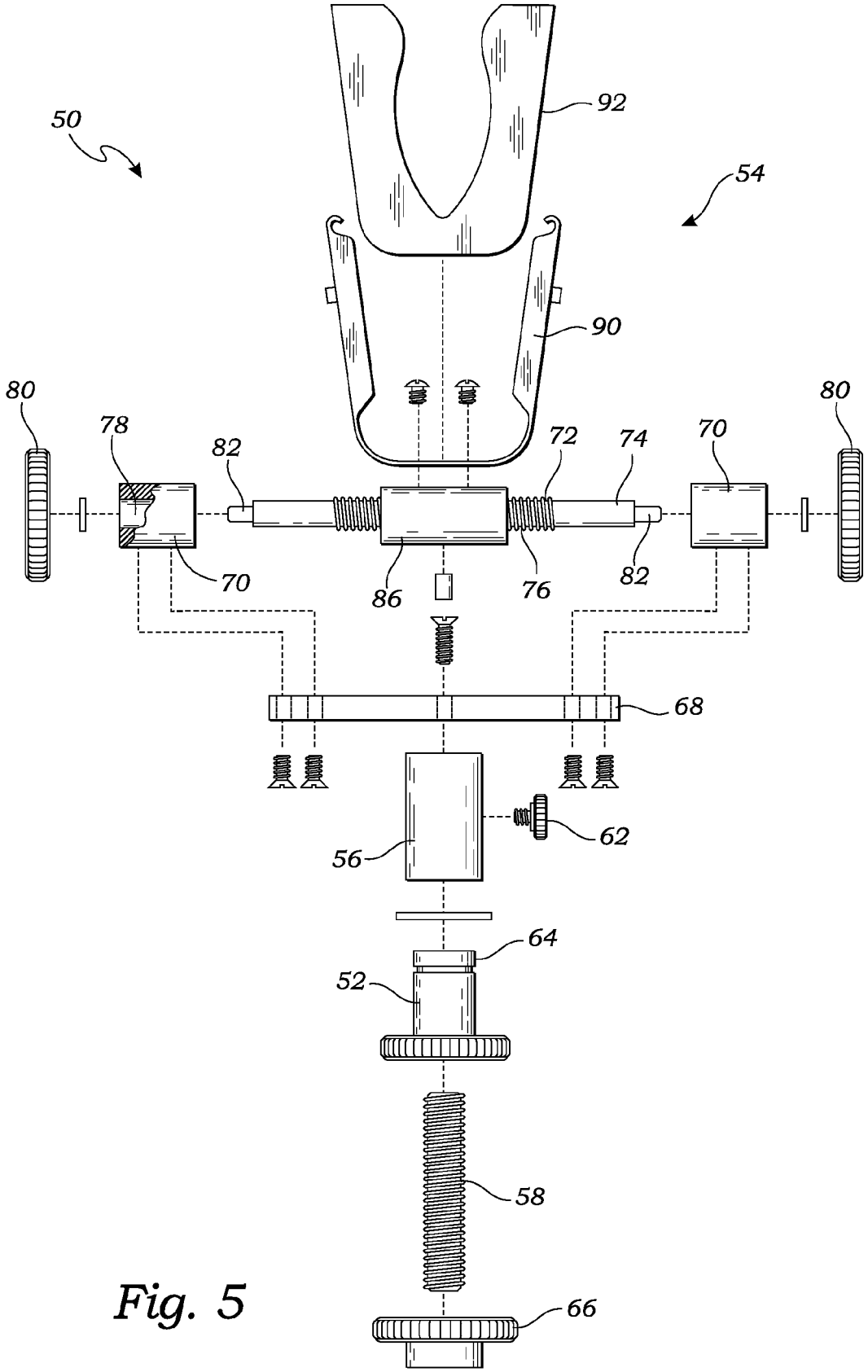
FIG. 5 is an exploded front elevational view of the forward cradle assembly.

FIG. 5 is an exploded front elevational view of the forward cradle assembly 50. As illustrated in FIG. 5, the forward cradle assembly 50 is mounted on the forward portion 24 of the table element 20, and comprises a mounting post 52 extending upwardly from the front portion the table element 20. The mounting post 52 may be mounted on the table element 20 using any constructions known in the art. The mounting post 52 supports a forward cradle 54 for supporting a forward part 14 (e.g., forestock) of the rifle 12.

In one embodiment, a mounting collar 56 is adapted to be removably mounted on the mounting post 52. In this embodiment, a mounting screw 58 is positioned through and threadedly engaged with the table element 20 (e.g., through an internally threaded bracket 60) to extend upwardly from the table element 20, and the mounting post 52 is mounted on the mounting screw 58. In this manner, rotation of the mounting screw 58 functions to vertically adjust the position of the mounting post 52, and thus the vertical position of the forward cradle 54. The mounting collar 56 may further comprise a locking screw 62 through the mounting collar 56 for engaging an annular groove 64 in the mounting post 52 for locking the mounting collar 56 on the mounting post 52. While the present embodiment illustrates a certain male/female relationship between the mounting post 52 and mounting collar 56, this relationship may be reversed, and the terms used herein are expressly defined to include the inverse interlocking relationship.

The mounting screw 58 may be used in conjunction with a front adjuster nut 66 that is threadedly mounted on the mounting screw 58 for locking the mounting screw 58 in a given position. The front adjuster nut 66 allows a user to lock the forward cradle 54 in a selected vertical position. While the mounting screw 58 and associated elements are utilized in the present embodiment for engaging the forward cradle 54 with the table element 20, alternative constructions (e.g., non-threaded post, or similar structure) may also be used, as can alternative locking elements.

An adjustment plate 68 is mounted on the mounting collar 56 and extends laterally therefrom. A pair of adjustment collars 70 are mounted on the adjustment plate 68 laterally spaced from one another. A lateral adjustment rod 72 has ends 74 and an externally threaded median portion 76. The ends 74 of the lateral adjustment rod 72 are engaged through a conduit 78 of the adjustment collar. The term "conduit" is hereby defined to include any form of passage, slot, or similar construction that may rotatably receive the adjustment post, as described herein. In the preferred embodiment, the adjustment collars 70 are generally cylindrical constructions that are attached to the adjustment plate 68 with screws, although welding and other methods are also possible.

An adjustment knob 80 is attached to one of the ends 74 of the lateral adjustment rod 72 for rotating the lateral adjustment rod 72 within the pair of adjustment collars 70. In one embodiment, a second adjustment knob 80 is also provided at the other end of the lateral adjustment rod 72, so that the horizontal position of the forward cradle assembly 50 may be adjusted from either side. In the embodiment of FIG. 5, adjustment knobs 80 are forcibly pressed onto studs 82 on each of the ends 74 so that the adjustment knobs 80 are fixedly engaged with the lateral adjustment rod 72. In alternative embodiments, they may be attached threadedly, with pins, or other methods of attachment.

An adjustment slide 86 is threadedly engaged with and supported by the externally threaded median portion 76 of the lateral adjustment rod 72, between the pair of adjustment collars 70, such that rotation of the adjustment knob 80 turns the lateral adjustment rod 72, thereby moving the adjustment slide 86 laterally with respect to the adjustment plate 68. In this embodiment, the forward cradle 54 is mounted on the adjustment slide 86 for supporting the rifle 12.

In one embodiment, the forward cradle 54 includes a pair of rigid, upwardly extending cradle arms 90, and a U-shaped foam component 92 positioned between the upwardly extending cradle arms 90. The U-shaped foam component 92 functioning to clamp the rifle 12 securely and yet without damaging the rifle 12.

Figure 6:
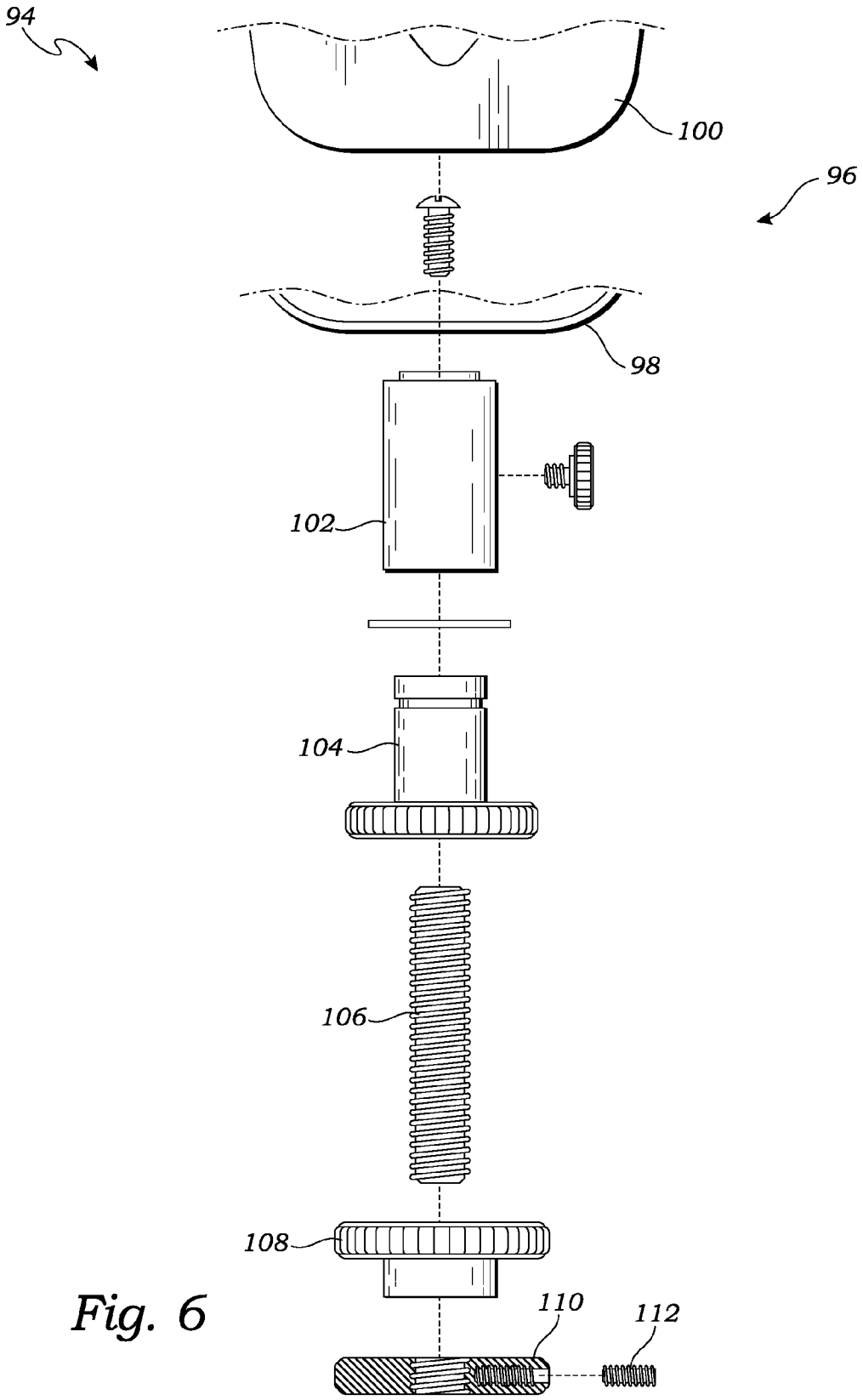
FIG. 6 is an exploded front elevational view of the rearward cradle assembly.

FIG. 6 is an exploded front elevational view of the rearward cradle assembly 94. The rearward cradle assembly 94 may be mounted on the rearward portion 26 of the table element 20 for supporting a rearward part 16 (e.g., butt stock) of the rifle 12. As illustrated in FIG. 6, the rearward cradle assembly 94 may include a construction similar to the forward cradle assembly 50, comprising a rearward cradle 96 supported by a rear mounting post 104.

The rearward cradle may include a rear mounting collar 102 attached to rear cradle arms 98 and a rear U-shaped foam component 100. The rear mounting collar 102 may be adapted to be removably mounted on the rear mounting post 104. In the present embodiment, a rear mounting screw 106 may be positioned through and threadedly engaged with the table element 20 (e.g., through an internally threaded bracket 60) to extend upwardly from the table element 20, and the rear mounting post 104 may mounted on the rear mounting screw 106. In this manner, rotation of the rear mounting screw 106 functions to vertically adjust the position of the rear mounting post 104, and thus the vertical position of the rearward cradle 96.

As with the forward cradle assembly 50, the rear mounting screw 106 may be used in conjunction with a rear adjuster nut 108 that is threadedly mounted on the rear mounting screw 106 for locking the rear mounting screw 106 in a given position. The rear adjuster nut 108 allows a user to lock the rearward cradle 96 in a selected vertical position.

In the present embodiment, the rearward cradle assembly 94 further includes a bottom adjustment knob 110 that is threadedly engaged with the rear mounting screw 106 and locked in place with a set screw 112. The bottom adjustment knob 110 enables the user to easily reach under the table element 20 and rotate the rear mounting screw 106 for fine adjustment of the vertical position of the rearward part 16 of the rifle 12.

While the rear mounting screw and associated elements are utilized in the present embodiment for engaging the rearward cradle with the table element 20, alternative constructions (e.g., non-threaded post, or similar structure) may also be used, as can alternative locking elements.

Figure 7:
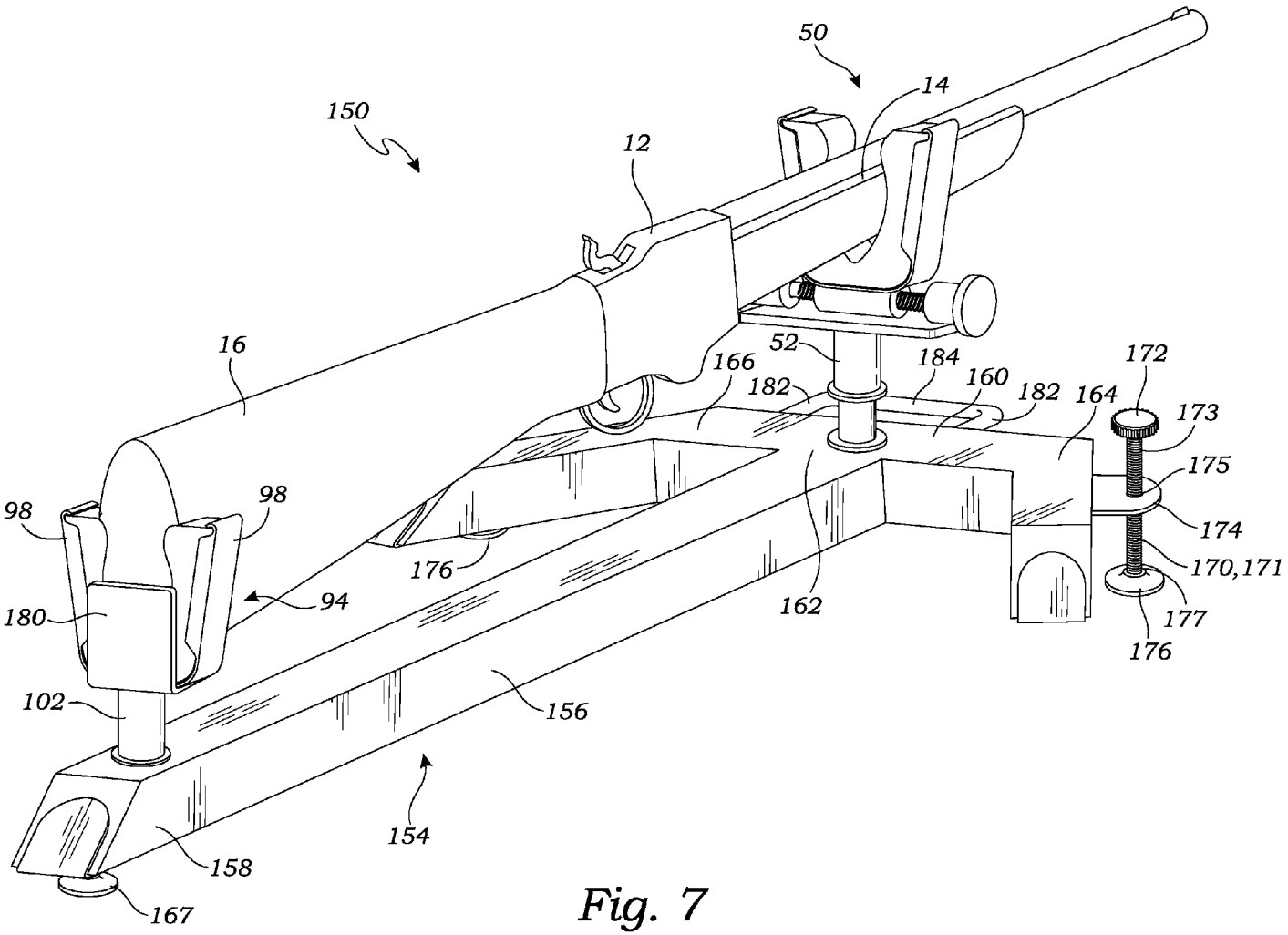
FIG. 7 is a perspective view of a second embodiment of the firearm support apparatus.

FIG. 7 is a perspective view of a second embodiment of the firearm support apparatus 150. In this embodiment, the table element includes a support frame 154 having a longitudinal center body 156 perpendicularly abutted by a lateral crosspiece 160. The rearward cradle assembly 94 may be operably attached to the rear of the longitudinal center body 158 to support the rearward part 16 (e.g., butt stock) of the rifle 12. Furthermore, a forward cradle assembly 50 may be mounted to a center 162 of the lateral crosspiece 160 by a mounting post 52 in order to support the forward part 14 (e.g., forestock) of the rifle 12. Although the form of the support frame 154 may vary according to the design of one skilled in the art, the preferred embodiment of FIG. 7 is generally T-shaped.

As illustrated in FIG. 7, the second embodiment of the firearm support apparatus 150 may include a pair of adjustable legs 170 extending downward from the right and left sides 164 and 166 of the lateral crosspiece 160 to support the rifle 12 on the ground, while the rearward part 158 of the longitudinal center body 156 may rest on a rear support 167, or directly on the ground. The at least two legs 170 may be adjustable, such that the user may vary the lengths of the legs according to the terrain, his or her comfort, and the placement of the target.

In the present embodiment, the legs 170 may be screw type (i.e., having an externally threaded surface 171), such that an adjustment knob 172 is mounted at a top end 173 of the leg 170, which extends downwardly to threadedly engaged with a threaded aperture 175 through an outwardly extending flange 174 to a lower end 177 that is attached to a support base 176, which may be disk-shaped, or otherwise shaped for resting upon the ground. The outwardly extending flange 174 extends from each of the right and left sides 164 and 166 of the lateral crosspiece 160, away from the forward cradle assembly 50, so that the adjustment knob 172 is operably positioned for use by the user while firing the rifle 12. The adjustment knob 172 enables the user to easily rotate the leg 170, which then moves relative to the flange 174 to adjust the vertical position of the forward part 14 of the rifle 12.

Also illustrated in FIG. 7, the firearm support apparatus 150 may further include a recoil support plate 180 mounted on the rear mounting collar 102 or other portion of the rearward cradle assembly 94. The recoil support plate 180 is positioned adjacent to and between the rear cradle arms 98, for supporting the rifle 12 when it is fired, and absorbing recoil forces from the rifle 12.

Also illustrated in FIG. 7, the firearm support apparatus 150 may further include a pair of posts 182 extending from the lateral crosspiece 160 opposite the elongate longitudinal center body 156, and on opposite sides of the forward cradle assembly 50. A crossbar 184 connects the pair of posts 182. The crossbar 184 is oriented generally parallel to the lateral crosspiece 160. The term generally parallel should be broadly construed to include positions that are somewhat angled, as long as the general orientation is parallel, this terminology is not meant to include geometric precision in construction.

In operation, the second embodiment of the firearm support apparatus 150 of FIG. 7 may be used to support the forestock and buttstock of a rifle 12, while remaining low to the ground. Such an invention is particularly useful for individuals practicing precision marksmanship, such as in sniper rifle training. While traditionally users have utilized sandbags or makeshift bipods to help when firing from a prone position, the present embodiment of the firearm support apparatus 150 allows for balanced positioning of the rifle 12 that may be sustained for an extended period of time. These features allow the weapon to consistently place shots within tight tolerances across various operational conditions, without sacrificing a low profile.

The adjustment knob 172 is conveniently positioned with respect to the user so that the user may use the adjustment knob 172 to adjust the longitudinal angle of the rifle 12 while laying prone. The positioning of the rifle 12 in the forward and rearward cradle assemblies 50 and 94 does not have to be changed at any time, as the orientation of the rifle 12 may be altered using the adjustment knobs 172 of the legs 170 (for vertical adjustments) and the adjustment knob 80 of the forward cradle assembly 50 (for horizontal adjustments).

The terminology used in the specification provided above is hereby defined to include similar and/or equivalent terms, and/or alternative embodiments that would be considered obvious to one skilled in the art given the teachings of the present patent application. Additionally, the words "a," "an,"

and "one" are defined to include one or more of the referenced item unless specifically stated otherwise. Also, the terms "have," "include," "contain," and similar terms are defined to mean "comprising" unless specifically stated otherwise.

What is claimed is:

1. A firearm support apparatus for supporting a rifle on a ground, the rifle having a forward part and a rearward part, the firearm support apparatus comprising:

a support frame having an elongate longitudinal center body and a lateral crosspiece having right and left sides that extend outwardly from the center body;

a forward cradle assembly comprising cradle arms fitting around and supporting the forward part of the rifle, the forward cradle assembly having rigid, upwardly extending forward cradle arms to fit around and support the forward part of the rifle;

a rearward cradle assembly mounted on a rearward portion of the longitudinal center body for supporting the rearward part of the rifle, the rearward cradle assembly having rigid, upwardly extending rear cradle arms to fit around and support the rearward part of the rifle;

an outwardly extending flange that extends from each of the right and left sides of the lateral crosspiece, away from the forward cradle assembly, each of the outwardly extending flanges having a threaded aperture therethrough;

a pair of adjustable legs for adjusting the height of the lateral crosspiece with respect to the ground, each of the legs having an externally threaded surface, an adjustment knob mounted at a top end of the leg, and a lower end that includes a support base, each of the adjustable legs being positioned through and threadedly engaging the threaded aperture of one of the outwardly extending flanges, so that the adjustment knob is operably positioned for use by the user while firing the rifle, the adjustment knob enabling the user to easily rotate the leg, which then moves relative to the flange to adjust the vertical position of the lateral crosspiece, thereby adjusting the vertical height of the forward part of the rifle;

a pair of posts extending from the lateral crosspiece opposite the elongate longitudinal center body, and on opposite sides of the forward cradle assembly; and a crossbar connecting the pair of posts, the crossbar being oriented generally parallel to the lateral crosspiece.

2. The firearm support apparatus of claim 1, further comprising a recoil support plate mounted on the rearward cradle assembly and positioned adjacent to and between the rear cradle arms for receiving recoil forces from the rifle when it is fired.

* * * * *